United States Patent [19]

Beck et al.

[11] 4,083,553

[45] Apr. 11, 1978

[54] COPY SHEET HANDLING APPARATUS FOR A COPIER

[75] Inventors: Christian A. Beck, Ridgefield; William A. Ross, Darien, both of Conn.

[73] Assignee: Pitney-Bowes, Inc., Stamford, Conn.

[21] Appl. No.: 743,983

[22] Filed: Nov. 22, 1976

[51] Int. Cl.[2] ..... B65H 1/04; B65H 3/06; B65H 31/02

[52] U.S. Cl. ..... 271/4; 271/117; 271/164; 271/170; 271/213

[58] Field of Search ..... 271/164, 170, 162, 157, 271/167, 171, 117, 213, 207, 4, 3, 5–7

[56] References Cited

U.S. PATENT DOCUMENTS

| | | | |
|---|---|---|---|
| 3,306,491 | 2/1967 | Eisner et al. | 271/117 X |
| 3,588,106 | 6/1971 | Csaba et al. | 271/170 |
| 3,599,971 | 8/1971 | Morioka | 271/162 X |
| 3,664,663 | 5/1972 | McPherson | 271/164 |
| 3,738,646 | 6/1973 | Samczyk | 271/170 |
| 3,762,813 | 10/1973 | Fowlie et al. | 271/4 UX |

*Primary Examiner*—Bruce H. Stoner, Jr.
*Attorney, Agent, or Firm*—Donald P. Walker; William D. Soltow, Jr.; Albert W. Scribner

[57] ABSTRACT

In a copier, there is provided copy sheet handling apparatus which includes an arrangement of the instrumentalities for aligning the end edges of a stack of copy sheets when the stack is being loaded and for then maintaining alignment of the end edges; and linkage for moving the respective aligning and alignment maintaining instrumentalities in a predetermined sequence to facilitate loading copy sheets in the copier.

2 Claims, 8 Drawing Figures

COPY SHEET HANDLING APPARATUS FOR A COPIER

BACKGROUND OF THE INVENTION

Commercially available electrostatic copying machines or copiers, generally include processing apparatus for forming and developing an electrostatic latent image on a moving photoreceptor and thereafter transferring the developed image from the photoreceptor to a copy sheet made of a suitable material such as paper. Thus the copiers are provided with copy sheet handling apparatus suitable for storing copy sheets, feeding the copy sheets to the processing apparatus and collecting the processed copy sheets.

The storing apparatus typically includes a shallow receptacle, or supply tray, which is periodically replenished with a stack of copy sheets. To facilitate replenishing the supply tray, it is well known in the art to slidably mount the same for movement between two positions, one of which is a copy sheet loading position and the other of which is a copy sheet feeding position. To avoid having the stacked sheets becoming misaligned with each other or spilling over the forward end of the supply tray to become entangled with the sheet processing apparatus, such copiers are ordinarily provided with a pair of spaced, upright corner posts, vertically slidably secured to the frame, for aligning the front end of the copy sheet stack. Each of the posts usually includes a finger portion extending therefrom to overhang a corner of the stack of copy sheets and restrain feeding sheets from the stack. When the supply of sheets is depleted, the posts have slidably moved downwardly a sufficient distance to seat the finger portions thereof on the forward end of the tray. To replenish the supply of copy sheets it is therefore necessary to raise the posts, and thus finger portions thereof, upwardly to permit alignment of the end edges of the new stack of copy sheets against the posts. Thus the posts are manually raised a sufficient distance to elevate the finger portions high enough above the tray to be able to locate the topmost sheet of the new stack of copy sheets beneath the overhanging finger portions; and after the new stack is loaded, the posts are lowered to seat the finger portions of the same on top of the new stack of sheets.

In such copiers, the likelihood of misalignment of the supply sheets at the storage station is only partially eliminated. Although the posts are intended to act as forward edge aligning devices, they do so only so long as the supply tray is not too forcefully moved to the storage station. The sheet loading process contemplates that the operator remember that he must manually raise the posts before returning the loaded tray to the storage station; and, as he does so, to slowly slide the tray forwardly and against the posts to avoid misalignment of the sheets; and to then carefully lower the posts to seat the finger portions of the same in engagement with the topmost sheet of the stack. Unfortunately, experience has shown that copier operators are often baffled by this procedure, since the posts are spaced about 8½ inches apart from each other; i.e., a distance which is sufficiently great to be a problem insofar as elevating the posts with one hand is concerned. Many operators respond to the challenge of loading a new stack of copy sheets by employing such creative sheet loading techniques as (a) super-elevating the posts above the level of the tray with both hands; quickly letting go of the posts; and, as the posts are falling, rapidly sliding the newly loaded tray against them before the finger portions fall to the level of the topmost sheet; or (b) jamming the posts in an elevated position, with whatever means comes most easily to hand; and then leisurely sliding the newly loaded tray against the immobilized posts. In either instance, there is a high probability of damaging the posts or tray, or both, as a result of which the copier cannot be used until it is repaired. Accordingly:

An object of the present invention is to provide, in a copier of the type which includes means for processing a plurality of copy sheets, improved apparatus for handling the copy sheets;

Another object is to provide a copier including improved means for loading a supply of copy sheets in the copier; and Yet another object is to provide means, in a copier, for accessing the copy sheet supply tray in a prescribed manner to avoid the problems of the prior art hereinbefore discussed.

SUMMARY OF THE INVENTION

In a copier including means for processing a plurality of copy sheets there is provided copy sheet handling apparatus which comprises means for supporting copy sheets and moving them between a loading position and a feeding position, means for aligning a loaded stack of sheets and means for maintaining alignment of a stack at the feeding position. Preferably, the alignment maintaining means includes means for restraining feeding sheets from the feeding position. In addition, there is provided means for feeding sheets, to the processing means which is adapted to release the sheets from the restraining means. Further, to facilitate loading the sheets, there is provided means for moving the aligning means and alignment maintaining means in a predetermined sequence ensuring proper alignment of the sheets at the feeding position.

BRIEF DESCRIPTION OF THE DRAWINGS

As shown in the drawings, wherein like reference numerals designate like or corresponding parts throughout the several figures.

DESCRIPTION OF THE PREFERRED EMBODIMENT

Figure 1:
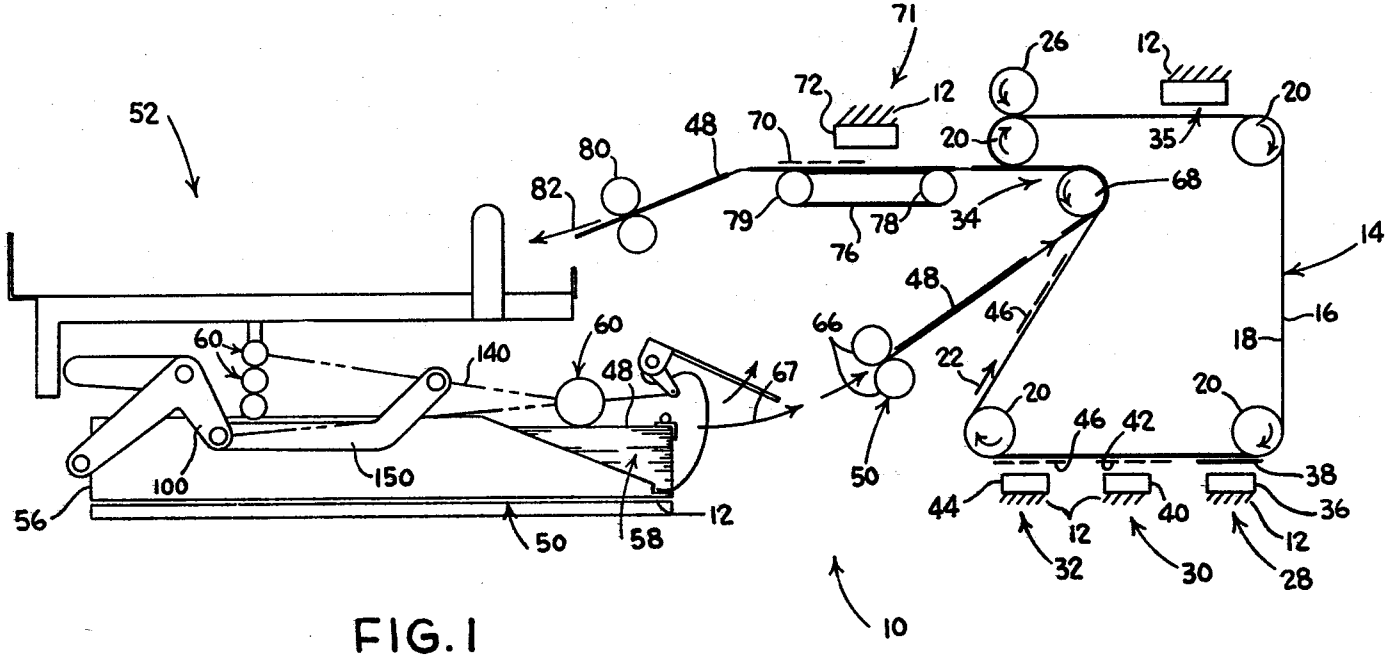
FIG. 1 is a schematic view of a copier according to the invention.

As shown in FIG. 1, an electrostatic copying machine, or copier, 10, of the type which may be improved in accordance with the present invention, generally includes suitable framework 12 for supporting the various processing means of the copier 10, including a photoreceptor 14. The photoreceptor 14 comprises a suitable flexible endless web having an outer surface 16 treated to exhibit photoreceptive characteristics, and an inner surface 18.

To movably support the photoreceptor 14 (FIG. 1) within the copier 10, the processing means includes a plurality of elongated rotatable idler shafts 20 about which the photoreceptor 14 is suitably endlessly looped, with its inner surface 18 disposed in engagement with the respective shafts 20. The idler shafts 20 are suitably secured to the framework 12 so as to longitudinally extend transverse to a desired path of travel 22 of the photoreceptor 14. In addition, the processing means includes an elongated driven shaft 26, rotatable in engagement with the outer surface 16 of the photoreceptor 14, to move the photoreceptor 14 in the aforesaid path of travel 22, through a charging station 28, imaging station 30, developing station 32, transfer station 34, and cleaning station 35.

At the charging station 28, (FIG. 1) the processing means includes suitable corona charging means 36 for depositing electrostatic charges 38 of suitable polarity on the photoreceptor's outer surface 16.

At the imaging station 30 (FIG. 1) the processing means includes suitable electro-optical means 40 for providing the photoreceptor 14 with suitable information, from a graphic image (not shown) carried by a document (not shown), causing the photoreceptor 14 to conduct and dissipate sufficient charge 38 from the photoreceptor's outer surface 16 to provide the same with a developable electrostatic latent image 42.

At the developing station 32, (FIG. 1) the processing means includes a suitable means 44 for developing the latent image 42 so as to render the same visible, thereby forming a transferable, developed image 46 on the outer surface 16 of the moving photoreceptor 14.

The developed image 46 (FIG. 1) is then transferred from the photoreceptor surface 16 to a suitable copy sheet 48 such as a sheet of paper.

To that end, the copier 10 (FIG. 1) includes paper handling apparatus 50, generally located at a copy sheet storage station 52, which comprises a receptacle, or supply tray, 56, on which there may be loaded a stack 58 of copy sheets 48; suitable sheet feeding means, such as a suitable buckle-loop sheet feeder 60 (FIG. 2) for feeding top sheets from the stack 58 (FIG. 1); and suitable feed roller means such as a pair of feed rollers 66 extending parallel to each other, for feeding the copy sheets 48 in a desired path of travel 67 to the transfer station 34.

At the transfer station 34 (FIG. 1) the processing means includes an elongated, rotatable shaft 68 suitably secured to the framework 12 so as to longitudinally extend transverse to the respective paths of travel, 22 and 67, of the moving photoreceptor 14 and copy sheet 48. The rotating shaft 68 is disposed in engagement with the moving copy sheet 48, and in sufficiently close proximity to the moving photoreceptor 14 to forceably urge the copy sheet 48 into sufficiently intimate engagement with the image bearing outer surface 16 of the moving photoreceptor 14 to transfer the developed image 46 to the copy sheet 48. The copy sheet 48, with a developed image 70 thereby formed thereon is then fed to a fusing station 71 of the copier 10. At the fusing station 71 the processing means includes suitable means 72 for fusing the developed graphic image 70 to the copy sheet 48 through the application of heat to the developed image 70. To that end, the processing means includes a suitable image bonding device such as hot-roll or heat-box type fuser 72 suitably secured to the framework 12.

At or beyond the fusing station 71 (FIG. 1) the copy sheet handling apparatus includes suitable means for feeding processed copy sheets 48 from the processing means, including for example, a movable belt 76, idler shaft 78, and rotatable driven shaft 79 and suitably located roller means 80. The processed copy sheet 48 is carried on the moving belt 76 through the fuser 72, and fed by the roller means 80 in a desired path of travel 82 to the copy sheet storage station 52.

Figure 8:
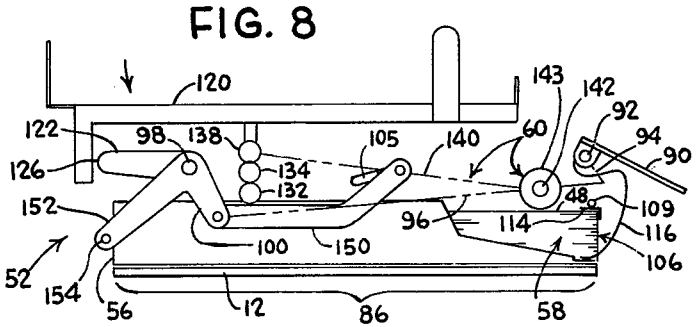
FIG. 8 is a view of the apparatus of FIG. 3 showing the aligned sheets being maintained in proper alignment.
Figure 4:
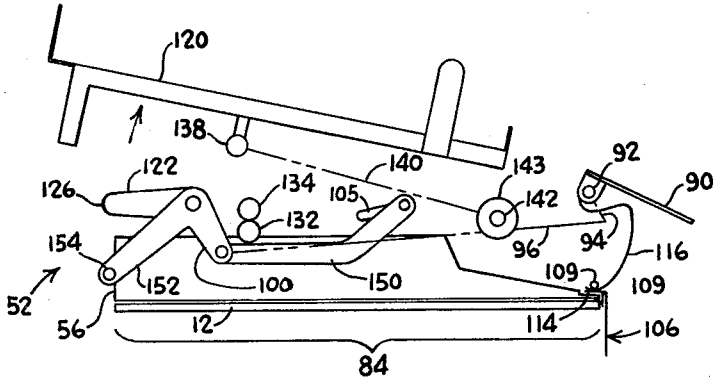
FIG. 4 is a view of the apparatus of FIG. 3, showing the receiving tray moved above the supply tray.
Figure 5:
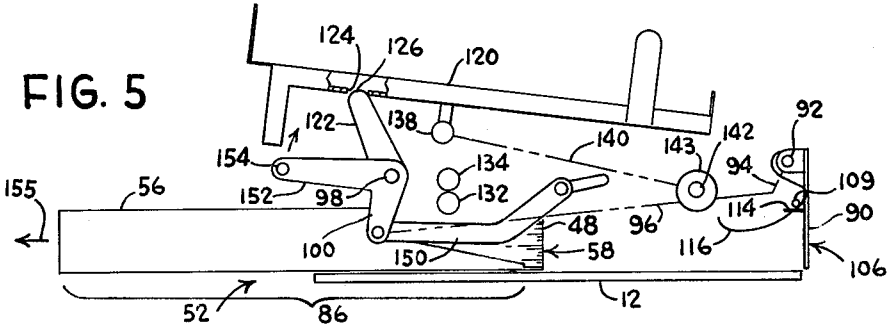
FIG. 5 is a view of the apparatus of FIG. 3, showing the loaded supply tray at the loading position.

At the storage station 52 (FIG. 4), the copy sheet supply tray 56 is suitably slidably secured to the framework 12 for movement between a feeding position 84 and a loading position 86 (FIG. 5). To permit loading a supply of copy sheets on the supply tray 56, the tray 56 is slidably moved from the feeding position 86 (FIG. 4) to the loading position 84 (FIG. 5). Whereupon the supply tray 56 may be loaded with a stack 58 of copy sheets 48 and slidably moved from the loading position 86 to the feeding position (FIG. 8) to permit feeding copy sheets 48 from the stack 58.

The copy sheet handling apparatus also includes means for aligning the end edges 48 (FIG. 5) of the copy sheet stack 58. The aligning means comprises a suitable stop 90, such as the plate shown in FIG. 2, and an elongated rotatable shaft 92 to which the stop 90 is suitably fixedly secured. The shaft 92 is rotatably attached to the framework 12 for moving the stop 90 to and between the raised position shown in FIG. 3 and lowered position shown in FIG. 5.

To raise and lower the stop 90 (FIG. 2), the sheet handling apparatus includes a lever arm 94, having one end suitably fixedly attached to the shaft 92; and a push-rod arm 96, having one end suitably pivotably attached to the other end of the lever arm 94. To actuate the push-rod arm 96 the sheet handling apparatus includes a manually rotatable shaft 98 having a oppositely disposed links 100 extending therefrom for movement therewith. At least one of the links 100 has a free end which includes a suitable pin 102 extending into a slot 103 formed in the other end of the push-rod arm 96 to move the push-rod arm 96, as it is shown in FIG. 2, to the left when the shaft 98 is rotated clockwise, and to the right when the shaft 98 is rotated counter-clockwise.

To maintain alignment of a stack 58 (FIG. 8) of loaded copy sheets 58, the sheet handling apparatus includes a pair of oppositely spaced, upright, corner posts 106 (FIG. 2), which are respectively suitably slidably attached to the framework 12, as by means of a connector 108. Each of the connectors 108 includes a pin 109, and is slidably mounted on a pair of rods 110 fixedly attached to the framework 12. The posts 106 each include a vertically-extending arm portion 112 and a horizontally-extending finger portion 114. The finger portion 114 (FIG. 8) is normally seated on the top sheet 48 of a loaded copy sheet stack 58 to restrain feeding sheets 48 therefrom.

Figure 2:
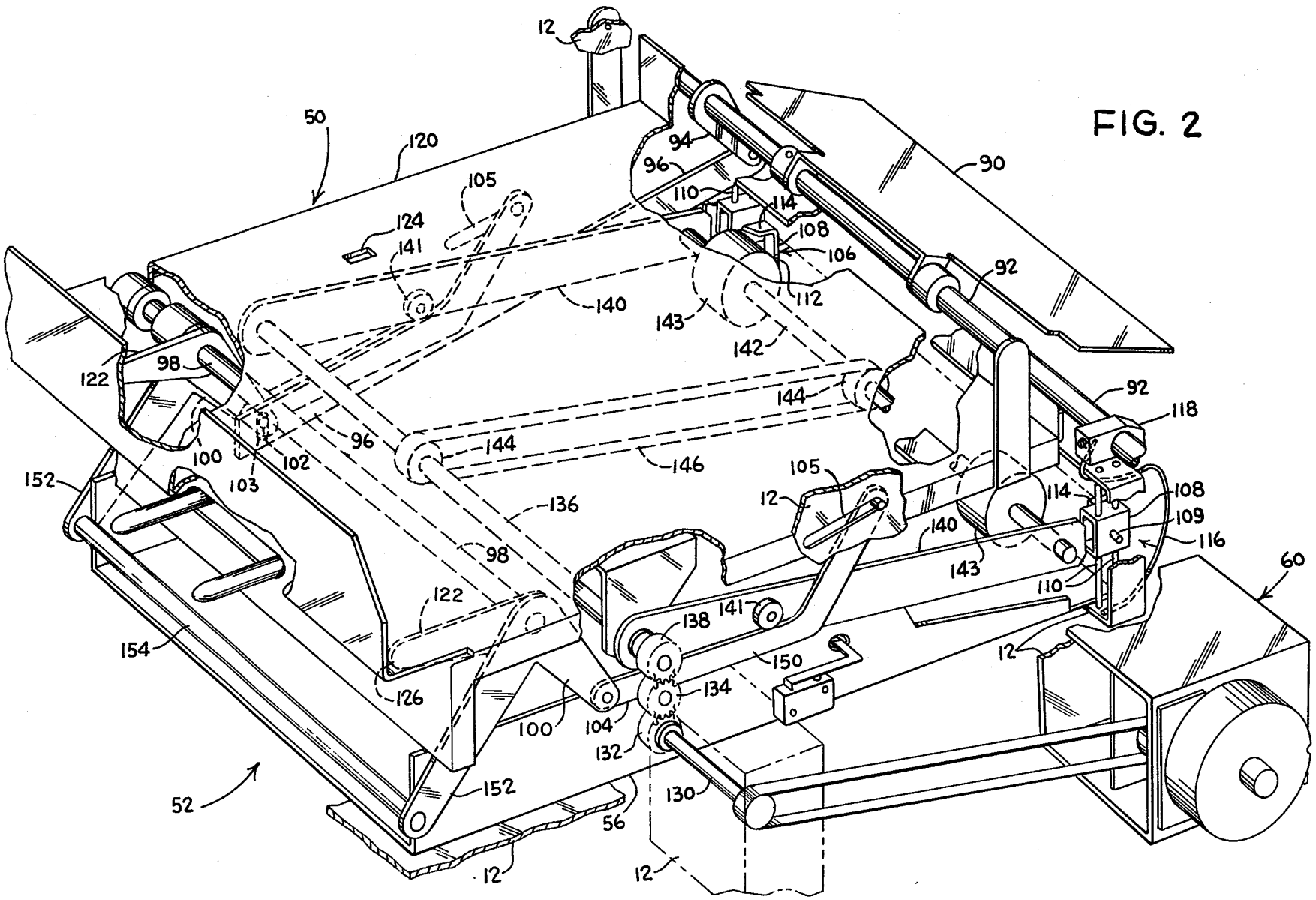
FIG. 2 is a fragmentary, perspective view of copy sheet handling apparatus according to the invention.

To move the posts 106 the sheet handling apparatus includes cam means such as a pair of oppositely disposed curvedly-extending, stiff wires 116, one of which is shown in FIG. 2. The wires 116 are respectively suitably fixedly attached to the rotatable shaft 92, as by means of a block 118 adjustably fixedly attached to the shaft 92. With this arrangement, as the shaft 92 clockwise rotates the plate 90 from the raised position shown in FIG. 2 to the lowered position shown in FIG. 5, the cam wires 116 respectively raise the associated connector pin 109, and thus the attached post 106, so as to dispose the finger portion 114 above the level of the top sheet of the loaded copy sheet stack 58, as shown in FIG. 5, to permit the copy sheet stack 58 to be positioned beneath the overhanging finger portion 114.

On the other hand, when the shaft 92 is rotated counter-clockwise, thereby raising the plate 90 from its lowered position (FIG. 5) to its raised position (FIG. 8), the cam means 116 lowers the connector pin 109 and thus the attached post 106 so as to seat the overhanging finger portion 114 on the top sheet 48 of the loaded copy sheet stack 58.

Figure 3:
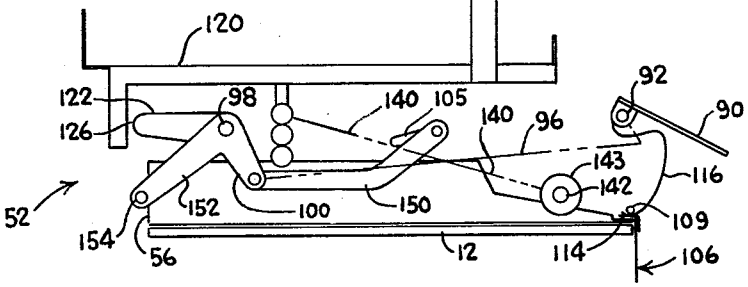
FIG. 3 is a reduced, fragmentary schematic view, in elevation, of the paper-handling apparatus of FIG. 2, showing the supply tray at the feeding position.

The sheet handling apparatus (FIG. 2) further includes a processed sheet receiving receptacle, or tray, 120 suitably pivotably attached to the framework 12 above the supply tray 56 for movement between a lowered position as in FIG. 3, and a raised position as shown in FIG. 4. In the lowered position (FIG. 3) the receiving tray 120 is positioned to receive processed copy sheets 48 from the processing means of the copier 10, whereas in the raised position (FIG. 4) the receiving tray 120 is positioned to refuse processed copy sheets 48.

To raise and lower the receiving tray 120 (FIG. 2), the copy sheet handling apparatus includes a pair of oppositely spaced links 122, each of which extends from the manually movable shaft 98 and is oriented with respect to the receiving tray 120 such that when the shaft 98 is rotated clockwise, the respective links 122 are rotated from their rest position as shown in FIG. 3, and bear against and raise the receiving tray 120 to its raised position (FIG. 5). To hold the raised tray 120 in place while loading copy sheets 48 on the supply tray 56 the receiving tray 120 is provided with a pair of oppositely spaced slots 124 dimensioned to receive the free ends 126 of the respective links 122. To move the receiving tray 120 to its lowered position (FIG. 8) the receiving tray 120 is manually raised above the level of the respective links 122, thereby freeing the free ends 126 of the links 122 from the receiving tray slots 124. Whereupon the shaft 98 and thus the links 122 may be rotated counter-clockwise and returned to their rest position as shown in FIG. 3. Of course, once the links 122 are free of the receiving tray slots 124 and partially rotated counter-clockwise, the receiving tray 120 may be released to permit the same to ride downwardly under the influence of gravity, on top of the free ends 126 of the links 122 as they are lowered to the rest position.

The sheet feeding means 60 (FIG. 2) comprises a suitably driven shaft 130, rotatably connected to the framework 12, a drive gear 132, and an intermediate gear 134 intermeshed with the drive gear 132. The intermediate gear 134 is suitably rotatably connected to the framework 12. In addition the sheet feeding means 60 includes a shaft 136, suitably rotatably connected to the receiving tray 120, which includes a driven gear 138 intermeshable with the intermediate gear 134 for rotating the shaft 136. Further, the sheet feeding means 60, includes a pair of oppositely spaced links 140, one end of each of which is rotatably secured to the driven shaft 136. The sheet feeding means 60 further includes a shaft 142, having its opposite ends rotatably secured to the other ends of the respective links 140, which includes a pair of spaced sheet engaging rollers 143 which rotates with the shaft 142. In addition, the sheet feeding means 60 includes a pair of gears 144, one which is fixedly attached to the shaft 142 and the other to the shaft 136; and an endless gear belt 146 looped about the respective gears 144 to transmit rotational movement of shaft 136 to shaft 142.

To raise the sheet engaging rollers 143 (FIG. 2) above the level of a copy sheet stack 58 when the receiving tray 120 is raised, at least one of the links 140 and the receiving tray 120 may respectively include a finger member (not shown) extending therefrom and oriented to engage each other when the receiving tray 120 (FIG. 4) is raised, thereby lifting the links 140, the attached shaft 142 and rollers 143 with the receiving tray 120. Alternatively and preferably, the sheet handling apparatus includes a pair of opposed links 100 having one end fixedly attached to the rotatable shaft 98 and the other end pivotally attached to an arm 150 slidable in a shaft 151 formed in the framework 12; and the respective links 140 may be provided with a roller 141 located for engagement by the arms 150, for raising the links 140 and thus the rollers 143 with the receiving tray 120 when the shaft 98 is rotated clockwise.

In addition, the copy sheet handling apparatus includes a pair of oppositely disposed links 152, each of which has one end fixedly attached to the manually rotatable shaft 98 and the other end joined by a bar 154 which extends therebetween and into the path of travel 155 (FIG. 5) of the supply tray 56. As a result, the supply tray 56 cannot be rearwardly moved until the bar 155 is moved from its rest position shown in FIG. 4 to a raised position as shown in FIG. 5.

Assuming the supply tray 56 is empty as shown in FIG. 3, and it is desired to load copy sheets 48 thereon, the supply tray 56 is accessed by lifting the bar 154, thereby raising the link 152 and rotating the shaft 98 clockwise. If an attempt is made to gain access to the copy sheet tray 56 by raising the receiving tray 120 without lifting the bar 154, the operator will be unable to slidably move the supply tray 56 to the left, as a result of which the tray 56 could not be loaded due to inaccessibility.

As the shaft 98 rotates clockwise, it rotates the link 122 against the receiving tray 120 to raise the tray 120. In the event that the links 149, arms 150 and roller 141 are provided for raising the rollers 143 with the receiving tray 120, rotation of the shaft 94 rotates links 149 clockwise to carry the arms 100 to the left, thereby causing the rollers 141 to ride upwardly on the arms 150 to raise the attached links 140 and thus the rollers 143 above the level at which the top sheet 48 (FIG. 5) of a copy sheet stack 58 is ordinarily disposed. Alternatively, the finger member (not shown) depending from the tray 120 engages the finger member (not shown) extending from the link 140 to raise the link 140, shaft 142 and attached rollers 143 above the level at which the top sheet 48 of the copy sheet stack 58 is ordinarily disposed. When the link's free end 126 locates itself in the receiving tray slot 124, the tray 120 is held in its raised position by the link 122 until the tray 120 is subsequently manually moved by the operator. In addition, the clockwise rotating shaft 98 rotates link 100 therewith to urge the attached push-rod arm 96 to the left, which in turn rotates link 94 and shaft 92 clockwise. As shaft 92 is rotated clockwise it rotates the cam means 116 and plate 90 clockwise, from the position shown in FIG. 4 to the position shown in FIG. 5, to lower the plate 90 and raise the connector pin 109 and thus the attached post 106. The post's finger portion 114 is thereby raised out of the path of travel 67 (FIG. 1) of copy sheets 48 fed from a copy sheet stack 58, and the plate 90 is lowered into that path of travel 67. Further, the post's finger portions 114 are moved above the level of the top sheet 48 (FIG. 5) of a typical stack of copy sheets 58 and the plate 90 is lowered between the posts 106.

Figure 6:
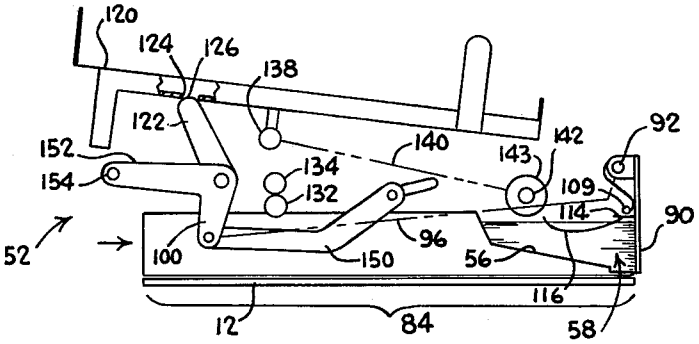
FIG. 6 is a view of the apparatus of FIG. 3, showing the loaded supply tray moved to the feeding position.
Figure 7:
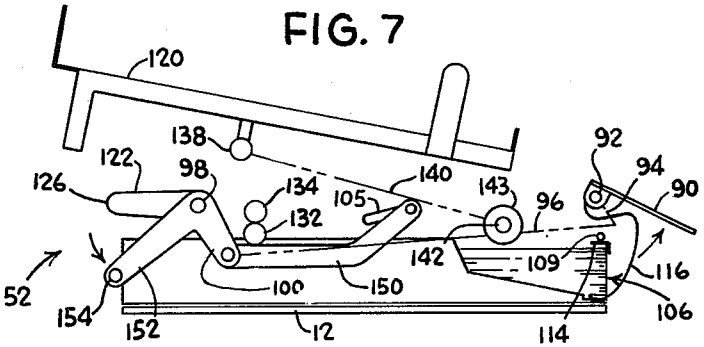
FIG. 7 is a view of the apparatus of FIG. 3, showing the alignment means being moved away from the loaded supply tray.

After lifting the bar 154, the copy sheet tray 52 may be moved from the feeding position 84 (FIG. 4) to the loading position (FIG. 5). Whereupon, the tray 56 may be loaded with a stack 58 of copy sheets 48 and slidably returned to the feeding position 84 (FIG. 6). Whether or not the supply tray 56 is forcefully moved to the feeding position 84, the lowered plate 90 obstructs continued movement of the copy sheet stack 58 and aligns the forward end edges of the respective sheets 48 of the stack 58 at the feeding position 84 of the supply tray 56. Further, it should be noted that since the top sheet 48 of the copy sheet stack 58 is below the respective overhanging corner finger portions 114 of the posts 106, the copy sheet stack 58 cannot be rammed into the same when the supply tray 56 is moved to the feeding position 84. And, still further, since the plate 90 is disposed between the posts 106 is prevents the copy sheet stack 58 from being forceably urged against the posts 106.

Assuming the loaded supply tray 56 has been moved to the feeding position 84, since the receiving tray 120 is then disposed to refuse processed copy sheets 48 the operator is thereby reminded that the tray 120 must be lowered to receive processed copy sheets 48. And, since the receiving tray 120 cannot be lowered until the link 122 is displaced from the receiving tray 120 aperture 124, the operator is thereby reminded to lower the bar 154.

To lower the bar 154, the receiving tray 120 is initially raised to free the link's free end 126 from the slot 124. Whereupon the bar 154 may be lowered; resulting in rotating the link 152, and thus shaft 98, counter-clockwise. When the link 122 is lowered away from the receiving tray slot 124 the receiver tray 120 may be released to permit the same to be lowered downwardly on top of the link 152. Of course, when the shaft 98 thus rotates, the link 100 moves arm 96 to the right to rotate link 94 and shaft 92 counter-clockwise. As a result, the plate 90 (FIG. 8) is raised to its upper position, and thus out of the path of travel of copy sheets 48 fed from the stack 58, and the cam means 116 lowers the connector pin 109, and thus the corner posts 106, downwardly. The corner post finger portions 114 are thereby seated on the top sheet 48 of the copy sheet stack 58 where they restrain feeding copy sheets 48 therefrom when the feed roller 143 is rotated for sheet feeding purposes.

In accordance with the objects of the invention there has been described an electrostatic copier including paper handling apparatus adapted to facilitate loading copy sheets in the copier without damaging the copier.

Inasmuch as certain changes may be made in the above described invention without departing from the spirit and scope of the same, it is intended that all matter contained in the above description or shown in the accompanying drawings shall be interpreted in an illustrative rather than limiting sense. And it is intended that the following claims be interpreted to cover all the generic and specific features of the invention herein described.

What is claimed is:

1. A copier comprising:

a. means for processing a plurality of copy sheets, a tray for supplying copy sheets, the supply tray being movable between a copy sheet feeding position and a copy sheet loading position;

b. means for aligning copy sheets on the supply tray;

c. means for restraining feeding sheets from the supply tray;

d. means for feeding copy sheets in a path of travel from the supply tray to the processing means;

e. means for moving said aligning means and restraining means respectively into and out of the path of travel of copy sheets fed from the supply tray;

f. said moving means including bar means normally disposed for preventing movement of the supply tray from the feeding position to the loading position, said aligning means being movable into and said restraining means being movable out of said path of travel of sheets fed from the supply tray in response to moving said bar means out of the path of movement of said supply tray;

g. a tray for receiving processed copy sheets;

h. means for feeding copy sheets from the processing means to the receiving tray; and i. said receiving tray being movable from a processed sheet receiving position to a processed sheet refusal position in response to moving said bar means out of the path of movement of said supply tray.

2. The copier according to claim 1 including said receiving tray movable to said processed sheet receiving position from said processed sheet refusal position in response to movement of said bar means into said path of movement of said supply tray.

* * * * *